United States Patent [19]
Fiedler

[11] 3,957,546
[45] May 18, 1976

[54] METHOD OF PRODUCING ORIENTED SILICON-IRON SHEET MATERIAL WITH BORON AND NITROGEN ADDITIONS

[75] Inventor: Howard C. Fiedler, Schenectady, N.Y.

[73] Assignee: General Electric Company, Schenectady, N.Y.

[22] Filed: June 9, 1975

[21] Appl. No.: 585,093

Related U.S. Application Data

[63] Continuation-in-part of Ser. No. 506,545, Sept. 16, 1974, abandoned, which is a continuation-in-part of Ser. No. 320,668, Jan. 2, 1973, abandoned.

[52] U.S. Cl. ..... 148/111; 75/123 L; 148/112; 148/31.55

[51] Int. Cl.[2] ..... H01F 1/04

[58] Field of Search ..... 148/110, 111, 112, 31.55; 75/123 L

[56] References Cited

UNITED STATES PATENTS

| | | | |
|---|---|---|---|
| 3,575,739 | 4/1971 | Fiedler | 148/111 |
| 3,700,506 | 10/1972 | Tanaka et al. | 148/111 |
| 3,725,143 | 4/1973 | Alworth et al. | 148/111 |
| 3,873,381 | 3/1975 | Jackson | 148/112 |

FOREIGN PATENTS OR APPLICATIONS

| | | | |
|---|---|---|---|
| 40-7663 | 4/1965 | Japan | 148/111 |

*Primary Examiner*—Walter R. Satterfield
*Attorney, Agent, or Firm*—Charles T. Watts; Joseph T. Cohen; Jerome C. Squillaro

[57] ABSTRACT

Silicon-iron sheet products of excellent magnetic properties can be produced by providing a hot-rolled band containing a small but critical amount of boron in critical proportion to the nitrogen content of the metal in which the manganese to sulfur ratio is less than 1.8, cold rolling the band directly to final thickness, and then heat treating the cold-rolled product to cause secondary recrystallization.

10 Claims, No Drawings

METHOD OF PRODUCING ORIENTED SILICON-IRON SHEET MATERIAL WITH BORON AND NITROGEN ADDITIONS

This is a continuation-in-part of my copending application Ser. No. 506,545, filed Sept. 16, 1974 (now abandoned), which is a continuation-in-part of my patent application Ser. No. 320,668, filed Jan. 2, 1973 now abandoned, all assigned to the assignee hereof.

The present invention relates generally to the art of making polycrystalline, magnetically soft, rolled silicon-iron products, and is more particularly concerned with a novel method of producing high-permeability, singly-oriented silicon-iron sheet through the use of boron in small but critical amounts and in critical ratio to the nitrogen content of the metal, and by maintaining the ratio of manganese to sulfur in the metal at less than 1.8.

CROSS REFERENCES

This invention is related to the invention disclosed and claimed in patent application Ser. No. 508,330, filed Sept. 23, 1974 now U.S. Pat. No. 3,905,842 , as a continuation-in-part of patent application Ser. No. 431,128 now abandoned, filed Jan. 7, 1974, as a continuation-in-part of patent application Ser. No. 326,852 now abandoned, filed Jan. 27, 1973, entitled "Method of Producing Oriented Silicon-Iron Sheet Material With Boron Addition" in the name of Herbert E. Grenoble and assigned to the assignee hereof, which pertain to the concept of using small but critical amounts of boron to enable the production of singly-oriented silicon-iron sheet of improved magnetic properties.

This invention is also related to my invention disclosed and claimed in patent application Ser. No. 506,546 now U.S. Pat. No. 3,905,843, filed Sept. 16, 1974, as a continuation-in-part of patent application Ser. No. 429,791 now abandoned. filed Jan. 2, 1974, as a continuation-in-part of patent application Ser. No. 320,669 now abandoned, filed Jan. 2, 1973, entitled "Method of Producing Oriented Silicon-Iron Sheet Material With Boron Addition," assigned to the assignee hereof, which pertain to the concepts of using small but critical amounts of boron to enable the production of singly-oriented silicon-iron sheet of improved magnetic properties by subjecting silicon-iron sheet containing manganese and sulfur in a ratio less than 2.1 to a cold rolling schedule including an intermediate annealing step and a final heavy cold rolling reduction.

BACKGROUND OF THE INVENTION

The sheet materials to which this invention is directed are usually referred to in the art as "electrical" silicon steels or, more properly, silicon-irons and are ordinarily composed principally of iron alloyed with about 2.2 to 4.5 per cent silicon and relatively minor amounts of various impurities and very small amounts of carbon. These products are of the "cube-on-edge" type, more than about 70 per cent of their crystal structure being oriented in the (110)[001]texture, as described in Miller Indices terms.

Such grain-oriented silicon-iron sheet products are currently made commercially by the sequence of hot rolling, heat treating, cold rolling, heat treating, again cold rolling and then final heat treating. Ingots are conventionally hot-worked into a strip or sheet-like configuration less than 0.150 inch in thickness, referred to as "hot rolled band." The hot rolled band is then cold rolled with appropriate intermediate annealing treatment to the finished sheet or strip thickness involving at least a 50 per cent reduction in thickness, and given a final or texture-producing annealing treatment.

In the preferred practice, the hot rolled band, having a thickness of 80 to 100 mils, after heat treating is cold rolled to about 30 mils. heat treated for an intermediate anneal, again cold rolled to final thickness, which may be about 10 to 14 mils commercially, and then finally annealed for decarburization and secondary recrystallization. Thus, the cold-rolling operation, in present practice, is done in two stages, with the intermediate anneal at about 900°–950°C. This intermediate heat treatment makes possible the development of strong cube-on-edge secondary recrystallization textures during the final anneal.

SUMMARY OF THE INVENTION

It has previously been recognized in U.S. Pat. No. 2,867,558 of John E. May, for example, that strong textures in conventional silicon-iron alloys require the presence of certain critical amounts of impurities in order to produce and control the desired intermediate grain size and degree of texture finally developed. It has not been known or recognized heretofore, however, that it is possible to eliminate the customary intermediate anneal between cold-rolling operations without adversely affecting the secondary recrystallization texture or the magnetic properties of the final product through the addition of small amounts of boron to the metal. The new method of the present invention is predicated upon that basic discovery and upon my additional discovery that the proportion of boron to nitrogen in the metal is also highly critical to the desired results. It is additionally based on my further discovery that during the final or texture-developing anneal there must be sulfur present in excess of that present as manganese sulfide. Manganese is an unavoidable impurity in commercial steel, and sufficient sulfur other than as manganese sulfide is present for the purposes of this invention if the ratio of manganese to sulfur is less than 1.8. Thus, the new advantages and results of this invention are obtainable over a broad range of manganese content from about 0.002 per cent to about 0.10 per cent. The sulfur content of the metal is preferably limited to approximately that required in accordance with this invention in the range from about 0.002 per cent to about 0.06 per cent, and those skilled in the art will understand that the sulfur requirement is important only at the final anneal stage and that one can therefore choose the time and the means for making any required addition of sulfur to the metal.

In more specific terms. I have found that the new results and advantages of this invention can be consistently obtained by adding from about three to about 35 parts per million of boron to a silicon-iron melt of manganese and sulfur content stated above, providing in addition that the nitrogen content of the metal is between 30 and 70 parts per million and that the ratio of nitrogen to boron is from one to fifteen parts per part of boron. Actually, the upper limit of nitrogen is flexible to the extent that blistering is avoided. Consequently, amounts in excess of 70 parts per million of nitrogen are not contemplated by this invention so far as the nitrogen-boron interelationship is concerned.

While the composition of the metal at the melt stage is referred to in the description of my discoveries, and the process of this invention based upon them, it will be understood that it is the composition of the metal at the hot band stage (and cold rolled stage) that is critical to the new results and advantages of this invention. However, in otherwise conventional processing operations, the loss of boron from the metal melt or during ingot soaking and subsequent hot and cold rolling and annealing operations will not be significant (on a bulk chemical analysis basis), although prolonged high temperature exposure will result in substantial elimination of boron and this occurs during the final or texture-developing annealing step of this new process. For this reason, the boron source material is preferably added to the ladle and the usual hot rolling schedule is begun as soon as the ingot is heated to hot rolling temperature. The sulfur, manganese and nitrogen contents of the metal are likewise preferably substantially the same at the melt and cold rolled stages, but the sulfur requirement of this invention can be provided at a later stage of the process if desired. Thus, as set forth in U.S. Pat. Nos. 3,337,991, 3,333,992 and 3,333,993, sulfur can be provided just before or during the primary grain growth stage of the final anneal by adding sulfur or a suitable sulfur compound to the annealing separator in amount sufficient to increase the sulfur content of the silicon steel to the level required for the desired secondary recrystallization texture-developing effect. Alternatively, the annealing atmosphere may be charged with hydrogen sulfide or other suitable sulfur compound gas, or such gas may be introduced into the decarburizing anneal atmosphere, that is, prior to the final anneal.

Another discovery which I have made and which also is embodied in the method of this invention is that a sheet product having magnetic properties superior to those of a conventional process involving an intermediate anneal during the cold rolling stage can consistently be produced by this new direct cold rolling method. Thus, not only does this invention enable simplification of the silicon-iron sheet production process (by eliminating one processing step), but also it opens the way to a higher grade product at reduced manufacturing cost.

I comtemplate, in addition, the use of selenium in place of part of or all the sulfur required in accordance with this invention. As in the case of sulfur, the selenium requirement of this new process can be met in various ways and at an early or a later stage of the process, my preference being to add the requisite amount to the ladle in elemental form or as ferroselenium.

I have further found that for consistently good results the hot rolled band should be heat treated before the cold rolling operation is begun. This heat treatment is actually a recrystallization anneal which results in at least partial recrystallization of the characteristic elongated hot rolled band structure. The desired result can be obtained by subjecting the band to a temperature between 800°C and 1000°C for from one to three minutes in a hydrogen atmosphere.

DETAILED DESCRIPTION OF THE INVENTION

Generally described in method terms, my present invention comprises the steps of providing a silicon-iron melt containing from 2.2 to 4.5 per cent silicon, amounts of manganese and sulfur within a ratio of manganese to sulfur less than 1.8, between about three and about 35 parts per million of boron and between about 30 and 70 parts per million nitrogen in the ratio to boron of one to fifteen parts per part of boron, casting the melt to form an ingot, hot rolling the ingot, cold rolling the resulting elongated sheet-like body to final thickness without reheating the cold-worked body, and finally heat treating the resulting sheet product to decarburize it and develop secondary recrystallization texture in it.

As indicated above, in accordance with this invention, the sulfur requirement of the metal can be provided late in the process instead of at the melt stage. In that event, the process is as generally described just above except that the melt contains between 0.002 and 0.10 per cent manganese and less than about 0.06 per cent sulfur, preferably somewhat less sulfur than that represented by the manganese to sulfur ratio of 1.8. Then during the final heat treatment, either in the decarburizing anneal or in the primary grain growth stage of the final anneal, the sulfur content of the cold-worked silicon steel sheet or strip is increased to bring the manganese to sulfur ratio below about 1.8.

Preferably, the boron addition will be between five and 25 parts per million and the silicon-iron is a product of a commercial steel refining process containing about 0.03 per cent each of manganese and sulfur, and about 0.03 per cent of carbon and usual amounts of incidental impurities. Likewise, the metal will contain about 45 parts per million of nitrogen and this nitrogen content will be provided in any convenient manner, preferably by conducting the melting operation in an air atmosphere.

The boron requirements of this invention may be provided by treatment of the melt in any suitable manner, such as by adding the required amount of ferroboron just before pouring. Other forms of boron which do not introduce detrimental impurities and do not result in significant loss of boron from the metal before the final anneal are suitable for this purpose. My preference, however, is to add ferroboron to the silicon-iron melt in the ladle.

As indicated above, a principal advantage of this invention is that it enables production of highly-oriented silicon-iron sheet or strip products having high magnetic permeability in the rolling direction by a route which involves fewer steps and is less expensive than present commercial methods.

The permeability values in the rolling direction of typical products of the present invention are in the range of 1850 to 1900 (in a 10-oersted magnetic field). These products exhibit, in addition, losses in the range of less than one watt per pound at 15,000 gauss and a thickness of 20 mils, and less than 0.60 watts per pound at a thickness of 11 mils.

According to the present invention, silicon steels are produced in the form of strips or sheets for use in transformers, motors and the like by providing a melt of silicon-iron of the required silicon, sulfur, manganese, boron and nitrogen content, pouring the melt, hot rolling the resulting ingot to a convenient thickness, pickling the resulting sheet to remove scale, annealing and then cold rolling to reduce its thickness by at least 50 per cent, suitably from 85 to 90 per cent. Thereafter, the cold-worked sheet is heat treated to decarburize it and to develop the desired cube-on-edge secondary recrystallization texture. The boron content of the sheet or strip product is largely eliminated during this final heat treatment stage, having in combination with the nitrogen and the sulfur in the metal served the critically important secondary recrystallization promotion purpose of this invention during the early phase of this final or texture anneal.

The following illustrative, but not limiting, examples of the method of this invention as I have carried it out will further inform those skilled in the art of the precise nature and special advantages of my present invention:

EXAMPLE I

An air-induction furnace charge of electrolytic iron and 98 per cent ferrosilicon was melted under an argon cover to produce a melt of the following composition:

| | | |
|---|---|---|
| Silicon | 3.1 | per cent |
| Carbon | 0.025 | " |
| Copper | 0.1 | " |
| Chromium | 0.03 | " |
| Manganese | 0.003 | " |
| Sulfur | 0.007 | " |
| Nitrogen | 0.0045 | " |
| Boron | Less than one part per million | |
| Iron | Remainder | |

Preparation of this and subsequent heats described below resulted in nitrogen contents from 30 to 60 parts per million with the above-indicated average content.

Slices 1.75 inch thick were cut from a 50-pound ingot cast from this melt and were hot rolled from 1225°C in six passes to a thickness of about 90 mils without reheating. The resulting hot-rolled bands were then pickled for scale removal and heated for three minutes at 900°C in a hydrogen atmosphere (dewpoint 0°C), and then cold rolled directly to final gauge thickness of 20.5 mils. Epstein-size strips (3 cm × 30.5 cm) were cut from this cold-rolled sheet product and decarburized at 800°C in hydrogen (room temperature dewpoint) for 3 minutes and then lightly dusted with alumina powder and stacked. Packs of the decarburized strips were heated for 1 hour in argon at 1000°C, and then heated to 1020°C in hydrogen for 3 hours. The permeability of the resulting product measured 1522 in a 10-oersted field. Watt losses measured 1,297 milliwatts per pound (mwpp) at 15,000 gauss.

EXAMPLE II

In another experiment using the melt chemistry and processing procedure described in Example I, five parts per million of boron in the form of ferroboron were added to the melt just prior to casting. The 20.5 mil product had permeability of 1849 in a 10-oersted field and watt loss of 913 mwpp at 15,000 gauss.

EXAMPLE III

The process of Example II was followed in every detail, including melt chemistry, except that the strip was cold rolled to 18.2 mils thickness and after decarburization was heated rapidly to 700°C and then at the rate of 50°C per hour in argon to 1020°C, then held three hours in hydrogen. The permeability at 10 oersteds was 1882 and the watt loss measured 818 mwpp at 15,000 gauss.

EXAMPLE IV

Again, following the procedure of Example I, a melt containing 0.011 per cent sulfur, but otherwise the same as that of Example I, was prepared and 3.1 parts per million of boron were added before casting, as described in Example II. After hot rolling from 1175°C, the processing to 11.3 mils final gauge was as set out in Example I. The resulting cold-rolled sheet was cut into watt loss strips which were decarburized and stacked as described in Example I. The strip pack was then heated rapidly to 800°C and then heated at the rate of 50°C per hour to 1050°C in nitrogen, and then heated in hydrogen at 1150°C for two hours. The permeability of the thus-treated product was 1888 in a 10-oersted field and the watt losses were 549 mwpp and 701 mwpp at 15,000 and 17,000 gauss, respectively.

Manganese is an unavoidable impurity in commercial steel, with 0.03 per cent representing a practical lower limit with current refining technology. The following examples show the effect of manganese and sulfur:

EXAMPLE V

Following the procedure of Example III except that the heat contained 0.034 per cent manganese, the permeability of the ultimate product after the final anneal was only 1556 gauss at 10 oersteds and the watt losses were 1208 mwpp at 15,000 gauss.

EXAMPLE VI

Following Example V procedure except that the sulfur content was raised to 0.023 per cent by adding iron sulfide to the melt, a product was obtained which, after the final anneal, had permeability of 1848 at 10 oersteds and watt losses of 837 mwpp and 1171 mwpp at 15,000 and 17,000 gauss, respectively. After reheating for three hours at 1150°C in hydrogen, the permeability increased to 1872 and the watt losses decreased to 773 and 1007 mwpp at 15,000 and 17,000 gauss, respectively.

While the heat of Example VI underwent complete secondary recrystallization, heats with less sulfur but otherwise of identical composition were found incapable of complete secondary recrystallization and, hence, of exhibiting good magnetic properties.

The effect of the amount of boron added to heats of about 0.034 per cent manganese and 0.03 per cent sulfur is illustrated in the following examples:

EXAMPLE VII

The procedure of Example I was duplicated with a melt the same as that of Example I, except that manganese and sulfur were present in amounts of 0.032 and 0.033 per cent, respectively, and cold rolling was continued until the silicon-iron sheet was 11 mils thick. The Epstein-size strips were cut and treated as described in Example I through the decarburizing step. For the final anneal following decarburization, watt loss strips (3 cm × 30.5 cm) were lightly dusted with alumina powder and stacked. Packs of these 11-mil strips were loaded at 800°C and heated at 50° per hour to 1050°C in nitrogen and then 1150°C in hydrogen where they were held for two hours. The permeability of the final product was found to be 1378 in a 10-oersted field and the watt loss measured 1240 milliwatts per pound (mwpp) at 15,000 gauss. It was thus established, and visually confirmed, that only normal grain growth occurred during the final anneal.

EXAMPLE VIII

Following the procedure of Example VII, except that 5 ppm boron as ferroboron were added to the melt, led to a final product in which secondary recrystallization was visually observed to be complete. The magnetic properties were good, permeability being 1868 in a 10-oersted field and watt losses being 545 mwpp and 714 at 15,000 and 17,000 gauss, respectively.

EXAMPLE IX

Again, the procedure of Example VII was followed with the exception that 10 ppm of boron as ferroboron were added to the melt. The final product, as in Example VIII, exhibited visual evidence of good secondary recrystallization and permeability measured 1882 in a 10-oersted field and watt losses were found to be of 546 mwpp and 704 mwpp at 15,000 and 17,000 gauss, respectively.

EXAMPLE X

In another test following the procedure of Example VIII, 15 ppm of boron were added to the silicon-iron melt with the result that the final product had permeability of 1890 in a 10-oersted field and watt losses of 541 mwpp and 697 mwpp at 15,000 and 17,000 gauss, respectively.

EXAMPLE XI

Following the procedure of the foregoing examples, 20 ppm of boron were incorporated in the silicon-iron melt containing 0.035 per cent sulfur but otherwise the same as that of Example VII, with the result that the final product had permeability of 1861 in a 10-oersted field and watt losses of 583 mwpp and 749 mwpp at 15,000 and 17,000 gauss, respectively.

EXAMPLE XII

In still another run, 25 ppm of boron were added to the silicon-iron melt, like that of Example XI prepared as described above. After processing in accordance with Example VII, a product was obtained which had permeability of 1841 in a 10-oersted field and watt losses of 612 mwpp and 807 mwpp at 15,000 and 17,000 gauss, respectively.

EXAMPLE XIII

In a test to determine the effect of still larger quantities of boron in the silicon-iron, 50 parts per million of boron were added to a silicon-iron melt containing 0.029 per cent manganese and 0.034 per cent sulfur but otherwise the same as that of Example VII and following the procedure outlined in the foregoing examples, a product was obtained which had magnetic properties similar to those of Example VII, permeability being 1484 in a 10-oersted field while watt losses were 988 mwpp and 1340 mwpp at 15,000 and 17,000 gauss, respectively.

EXAMPLE XIV

This was the first in a series of experiments to test the present invention on silicon-irons of manganese content greater than 0.03 per cent. The procedure of Example VII was followed in the preparation of a melt the same as that of Example VII except that the manganese content was 0.042 per cent and the sulfur content was 0.037 per cent, and 5 ppm of boron was added. Processing according to Example VII resulted in a final product having permeability of 1871 at 10 oersteds and watt losses of 550 and 714 mwpp at 15000 and 17,000 gauss, respectively.

EXAMPLE XV

In another run following the procedure of Example XIV, the melt contained 0.041 per cent manganese, 0.044 per cent sulfur and 15 ppm of boron was added. The final product had permeability of 1887 at 10 oersteds and watt losses of 549 and 693 mwpp at 15,000 and 17,000 gauss, respectively.

EXAMPLE XVI

Again, following the Example XIV practice, the melt contained 0.054 per cent manganese, 0.047 per cent sulfur and 5 ppm of boron was added. The resulting product had a permeability of 1892 at 10 oersteds and watt losses of 549 and 701 mwpp at 15,000 and 17,000 gauss, respectively.

EXAMPLE XVII

Again, following the procedure of Example XIV, a melt was prepared containing 0.054 per cent manganese, 0.033 per cent sulfur and 10 ppm of boron was added. The properties of the resulting product were poor, permeability measuring 1493 at 10 oersteds and watt loss being 961 mwpp at 15,000 gauss. The ratio of manganese to sulfur of this heat was 1.63.

The utility of selenium in this process was demonstrated in a laboratory experiment in which a heat was prepared by melting electrolytic iron and 98 per cent ferrosilicon in an air induction furnace under an argon cover. Five parts per million of boron were added, and also 0.025 per cent selenium. The chemical analysis of the heat was as follows:

| % Mn | % S | % Se | % Si | % Cu | % Cr | % C |
|---|---|---|---|---|---|---|
| 0.033 | 0.005 | 0.019 | 3.1 | 0.1 | 0.03 | 0.03 |

A slice 1.75 inches thick cut from the resulting ingot was hot rolled from 1200°C in six passes, without reheating, to a thickness of about 90 mils. Following hot rolling and pickling, the hot rolled band was heated for three minutes at 900°C in hydrogen and then cold rolled directly to final thickness of 10.8 mils. Epstein strips were decarburized by heating for three minutes in wet hydrogen and then separated with alumina powder and given the final anneal. The final anneal consisted of heating at 50°C per hour from 800°C to 1050°C in nitrogen, then in hydrogen to 1175°C and holding for 3 hours. The measured magnetic properties of the product were:

| mwpp | | |
|---|---|---|
| 15kB | 17kB | μ10H |
| 537 | 689 | 1893 |

EXAMPLE XVIII

The procedure of Example I was followed with a melt the same as that of Example I, except that manganese and sulfur were present in amounts of 0.023 and 0.013 per cent, respectively, (a manganese to sulfur ratio of 1.8) the melt contained 0.040 per cent carbon and 10 parts per million of boron, hot rolling was from 1200°C, and the hot rolled band was heat treated at 950°C in hydrogen (dewpoint 0°C) for 3 minutes and then cold rolled to final gauge thickness of 11 mils. The permeability of the final product was found to be 1865 in a 10-oersted field.

EXAMPLE XIX

The procedure of Example XVIII was followed but for the fact that the melt contined 0.024 and 0.009 per cent manganese and sulfur, respectively. The final product was found to have permeability of 1650 (in a 10-oersted field).

EXAMPLE XX

Again, the procedure of Example XVIII was followed except that the melt contained 0.024 and 0.016 per cent manganese and sulfur, respectively. The product had permeability of 1890 (in a 10-oersted field).

EXAMPLE XXI

Following the procedure of Example I, a melt containing 0.005 per cent sulfur, 0.024 per cent manganese, 50 parts per million of nitrogen and 10 parts per million of boron, but otherwise the same as that of Example I, was prepared and cast and slices from the resulting ingot were hot rolled from 1200°C in six passes to 90-mils thickness reheating. After pickling, the hot rolled bands were heat treated for two minutes at 950°C and then cold rolled to 10.8 mils without an intermediate heat treatment. Epstein packs were prepared from a portion of the cold rolled strip and decarburized at 800°C in hydrogen (room temperature dewpoint) for three minutes and then coated with magnesia and heated to 1175°C in hydrogen. The permeability of the resulting product measured 1504 in a 10-oersted field. Watt losses measured 1293 mwpp at 17,000 gauss.

After the same decarburizing heat treatment, a single strip was coated with a mixture of milk of magnesia and Epsom salts such that after removal of the water of hydration, the coating consisted of 25 per cent sulfur and 75 per cent magnesia. After the final or texture-developing anneal described above, the permeability was found to be 1892 (in a 10-oersted field) and the watt losses were 756 mwpp (at 17,000 gauss).

EXAMPLE XXII

In another experiment the same as that of Example XXI, except that the melt contained 0.036 per cent manganese and 0.013 per cent sulfur, the effect of sublimed sulfur in the magnesia coating was tested. The permeability of the strips of the Epstein pack not provided with a sulfur-containing magnesia coating was 1491 (in a 10-oersted field) and the watt losses were 1335 mwpp (at 17,000 gauss).

The other strips coated with milk of magnesia mixed with sublimed sulfur in an amount such that after removal of wter of hydration the coating consisted of 45 per cent sulfur and 55 per cent magnesia were found after the above-described heat treatment to have permeability of 1878 (in a 10-oersted field) and watt losses of 735 mwpp (at 17,000 gauss).

Whatever in the present specification and claims reference is made to amounts, ratios, percentages or proportions, the weight basis is meant and intended unless otherwise expressly stated.

As used herein and in the appended claims, the term "ingot" means and refers to a body made by solidifying by any casting method a molten steel made by any suitable steelmaking method, and this includes a slab-like ingot obtained by a continuous casting method.

What I claim as new and desire to secure by Letters Patent of the United States is:

1. The method of producing grain-oriented silicon-iron sheet which comprises the steps of providing a silicon-iron melt containing 2.2 to 4.5 per cent silicon, amounts of manganese and sulfur within a ratio of manganese to sulfur less than 1.8, between about three and 35 parts per million of boron, and between about 30 and 70 parts per million nitrogen in the ratio to boron of one to 15 parts per part of boron, casting the melt to form an ingot, hot rolling the ingot to produce an elongated sheet-like body, heat treating the said hot-rolled body to effect at least partial recrystallization, cold rolling the said hot-rolled body and reducing its thickness to final gauge thickness without reheating the cold-worked sheet, and thereater subjecting the cold-worked sheet to a final heat treatment to decarburize it and to develop (110) [001] secondary recrystallization texture in it.

2. The method of claim 1 in which the melt contains less than 0.01 per cent sulfur, less than 0.01 per cent manganese, and in which from five to 25 parts per million of boron are added to the melt.

3. The method of claim 1 in which the melt contains about 0.03 per cent sulfur and about 0.03 per cent manganese, and in which from five to 15 parts per million of boron are added to the melt.

4. The method of claim 1 in which the sulfur content of the melt is about 0.04 per cent and the manganese content of the melt is about 0.04 per cent and in which five to 15 parts per million of boron are added to the melt.

5. The method of claim 1 in which the manganese and sulfur content of the melt are about 0.05 per cent and 0.05 per cent, respectively, and in which five to 10 parts per million of boron are added to the melt.

6. The method of producing grain-oriented silicon-iron sheet which comprises the steps of providing a silicon-iron melt containing 22 to 4.5 per cent silicon, additionally containing sulfur in amount from 0.002 to 0.05 per cent or selenium in amount from 0.002 to 0.05 per cent or sulfur and selenium in aggregate amount within the range of 0.002 to 0.05 per cent, and additionally containing 0.002 to 0.09 per cent manganese in an amount in the ratio to sulfur or to selenium or selenium plus sulfur of less than 1.8, and containing between 30 and 70 parts per million nitrogen, and finally containing incidental impurities and the balance consisting of iron, adding from three to 35 parts per million of boron to the melt and thereby establishing a nitrogen to boron ratio in the melt of one to fifteen parts of nitrogen per part of boron, casting and hot rolling to form an elongated sheet-like body, heat treating the said body to effect at least partial recrystallization, cold rolling directly to final desired thickness without reheating the cold-worked sheet, and finally heat treating the resulting sheet product to decarburize and develop (110) [001] secondary recrystallization texture in it.

7. The method of claim 6 in which the metal melt contains 0.033 per cent manganese, 0.019 per cent selenium, and 0.005 per cent sulfur, and in which five parts per million of boron were added to the melt.

8. The method of producing grain oriented silicon-iron sheet which comprises the steps of providing a hot-rolled band of intermediate thickness containing 2.2 to 4.5 per cent silicon, between three and 35 parts per million of boron, between 30 and 70 parts per million of nitrogen in the ratio of boron of one to 15 parts per part of boron, and amounts of manganese and sulfur within a ratio of manganese to sulfur less than 1.8, heat treating the hot-rolled band to effect at least partial recrystallization of the charcteristic elongated hot-rolled band grain structure, cold rolling the hot-rolled band and reducing it to final gauge thickness without reheating the metal, and thereafter subjecting the resulting cold-worked sheet to a final heat treatment to develop (110) [001] secondary recrystallization texture in it.

9. The method of producing grain oriented silicon-iron sheet which comprises the steps of providing a hot-rolled band of intermediate thickness containing 2.2 to 4.5 per cent silicon, between three and 35 parts per million of boron, between 30 and 70 parts per million of nitrogen in the ratio to boron of one to fifteen parts per part of boron, and between 0.002 and 0.10 per cent manganese and less than about 0.06 per cent sulfur, heat treating the hot-rolled band to effect at least partial recrystallization of the characteristic elongated hot-rolled band grain structure, cold rolling the hot-rolled band and reducing it to final gauge thickness without reheating the metal, and thereafter subjecting the resulting cold-worked sheet to a final heat treatment to develop (110)[001] secondary recrystallization texture in it.

10. The method of claim 9 in which the ratio of manganese to sulfur in the cold-worked sheet is greater than 1.8, and in which the sulfur content of the said sheet is increased during the final heat treatment to reduce the manganese to sulfur ratio below about 1.8.

* * * * *